United States Patent [19]

Herder

[11] 4,293,408

[45] Oct. 6, 1981

[54] BAR END SEPARATOR

[75] Inventor: Gary A. Herder, Kalamazoo, Mich.

[73] Assignee: Prab Conveyors, Inc., Kalamazoo, Mich.

[21] Appl. No.: 111,720

[22] Filed: Jan. 14, 1980

Related U.S. Application Data

[62] Division of Ser. No. 960,921, Nov. 15, 1978, Pat. No. 4,219,410.

[51] Int. Cl.[3] ..... B07B 3/00

[52] U.S. Cl. ..... 209/638; 209/932

[58] Field of Search ..... 209/143, 147, 44, 2, 209/540, 136, 139 R, 139 A, 133, 134, 142, 145, 149, 543, 638, 932

[56] References Cited

U.S. PATENT DOCUMENTS

| | | | |
|---|---|---|---|
| 1,987,640 | 1/1935 | Rothgarn | 209/136 |
| 2,162,392 | 6/1939 | Solomon | 209/137 |

*Primary Examiner*—Frank Sever

*Attorney, Agent, or Firm*—Dressler, Goldsmith, Shore, Sutker & Milnamow, Ltd.

[57] ABSTRACT

Separation of heavy tramp metal pieces from lighter weight machine tool turnings and chips is accomplished by apparatus and method in which turnings or chips containing tramp objects are moved along a conveying path and across an elongate free-fall area or region which is generally transverse to the conveying path. A stream of gas is directed through the free-fall area to blow the chips and turnings away from the free-fall area and into a separate processing path while the tramp objects fall through the free-fall area under the influence of gravity. In order to ensure than the tramp objects are properly dumped into the elongate free-fall area and do not bridge the free-fall area in the conveying path, an abutment member is placed along the elongate free-fall area for deflecting a leading portion of an elongate tramp metal object upwardly and/or sidewardly with respect to the conveying path. The tramp object thus becomes oriented so that it fits endwise and/or lengthwise within the elongate free-fall area and drops therethrough.

8 Claims, 3 Drawing Figures

BAR END SEPARATOR

This is a division of application Ser. No. 960,921, filed Nov. 15, 1978, now Pat. No. 4,219,410.

BACKGROUND OF THE INVENTION

This invention relates to conveyor path parts separators such as the so-called bar end separators.

Bar end separators are used to separate tramp objects such as rods, bar ends, heavy tramp metal, and other heavy objects from light and fluffy turnings and chips produced by machine tool material removal operations. It is desired to remove such relatively heavy objects from relatively lighter weight turnings and chips because the lighter weight turnings and chips are typically processed by crushing and subsequent compacting so as to reduce the volume as an aid to further handling and storage, which further handling may include shipment to metal ssalvage plants.

Typically, the turnings and chips from machine tool operations are collected and conveyed from various machine tool work stations by a conveyor or other suitable means. The collected turnings and chips are generally very tangled and tramp objects are frequently trapped and buried within the turnings. Consequently, it is difficult to separate the tramp objects from the turnings.

Typically, bar end separators employ a vibrating bed or conveyor for carrying the mass of scrap turnings and tramp metal toward a drop-off point, such as a slot or gap in the conveyor. A stream of air is directed from below the conveyor through the slot or drop-off point. As the air passes through the gap, gravity causes the heavy tramp objects to fall through the gap and into a discharge chute. The lighter weight turnings and chips are blown away from the gap and into another collecting chute.

In the past, there have been problems with achieving good separation of tramp objects from the turnings and chips. Specifically, elongate pieces of bar stock or tramp metal have a tendency to bridge the slot or gap in the conveyor bed of the bar end separator. When the elongate pieces of tramp metal bridge the slot, they do not fall through the gap as intended. Consequently, they may continue to pass over the gap and be vibrated off the end of the conveyor, usually into the chip collecting area. Obviously, this is undesirable and a method and apparatus for preventing this occurrence would be most beneficial.

With some bar and separators in use today, centrifugal fans are used to generate the air stream and the air stream can carry away the lightest chips and propel them into the return air ducting of the fan. It would be desirable to provide a method and apparatus for eliminating or greatly reducing this possibility. Currently, many bar end separators attempt to eliminate this problem by having a screen over the return air inlet duct to the fan. However, these screens are quickly clogged. Thus, it would be desirable to provide a method and apparatus for keeping the light turnings and chips out of the fan without using a screen.

SUMMARY OF THE INVENTION

According to the present invention, a bar end separator is provided with an abutment means that deflects tramp objects present in turnings and/or chips into an elongate aperture transverse to the conveying path of the turnings and/or chips. The contemplated apparatus includes a conveyor means for the turnings and/or chips that defines at least a portion of the elongate aperture and coacts with the abutment means to orient the tramp objects for passage through the aperture. A blower means, such as a fan, is provided for producing a gas stream which is directed through the aperture to blow the lighter weight chips and turnings away from the aperture and into a separate processing path. The abutment is angled and is positioned along the elongate aperture for deflecting a leading portion of an elongate tramp object so that the tramp object is oriented upwardly and/or sidewardly with respect to the conveying path and so that the tramp object can pass endwise and/or lengthwise through a free-fall region or area provided by the elongate aperture by the action of gravity.

In the bar end separator embodying the present invention, the gas stream is confined within an enclosed passageway and is returned through suitable ductwork to the fan. To prevent lightweight particles, chips and turnings from being returned to the fan inlet, a baffle plate is interposed in the trajectory of the chips as they are blown off of the conveyor while passing over the elongate aperture. The blown chips impinge upon the baffle plate and are thus prevented from entering the return duct.

Numerous other advantages and features of the present invention will become readily apparent from the following detailed description of the invention and of the disclosed embodiments thereof, from the claims and from the accompanying drawings.

It is seen that the combined effect of the various elements of the apparatus of the present invention is not merely equal to the sum of the several effects in these elements alone. Rather, the novel combination of elements in accordance with the present invention yields desirable and synergistic results—results which are a substantial improvement over the prior art.

BRIEF DESCRIPTION OF THE DRAWINGS

In the accompanying drawings forming part of the specification, and in which like numerals are employed to designate like parts throughout the same.

DESCRIPTION OF PREFERRED EMBODIMENTS

Figure 1:
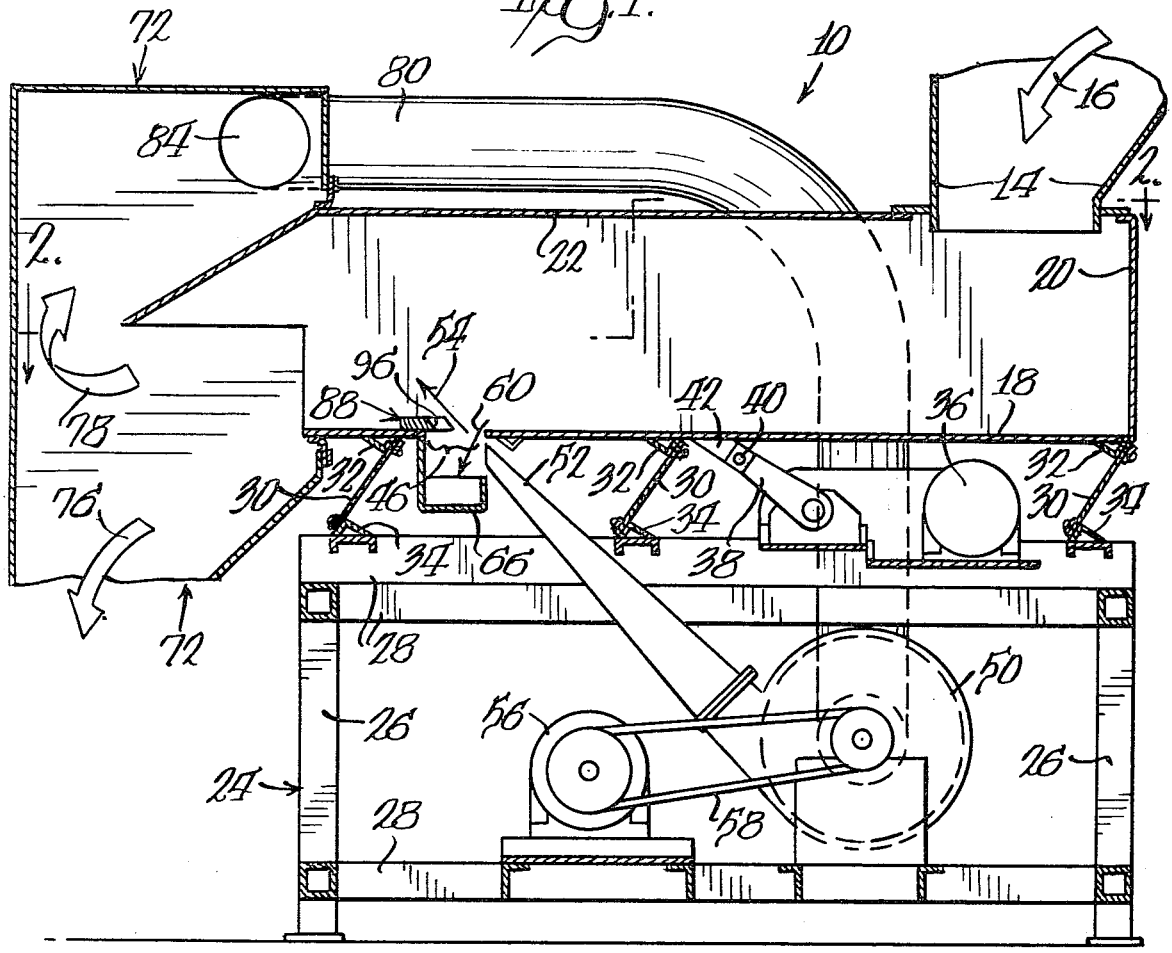
FIG. 1 is a fragmentary, cross-sectional view of the apparatus of the present invention.

While this invention is susceptible of embodiment in many different forms, there are shown in the drawings and will herein be described in detail specific embodiments, with the understanding that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only reference to an embodiment which is simple and straightforward.

It will be understood that reference made herein, and in the claims, to various terms such as "pressurized gas stream", "stream of gas", etc., are merely illustrative.

Such terms are used herein in a non-technical sense, and are intended to include various fluids in a moving or flowing condition and which have the capability for carrying particles and pieces of matter.

For ease of description, the apparatus of this invention will be described in a normal operation position, and terms such as upper, lower, horizontal, etc. will be used with reference to this normal operating position. It will be understood, however, that the apparatus of this invention may be manufactured, stored, transported and sold in an orientation other than the normal operating position described.

The apparatus of this invention has certain conventional drive mechanisms and control mechanisms the details of which, though not fully illustrated or described, will be apparent to those having skill in the art and understanding of the necessary functions of such drive mechanisms.

The bar end separator apparatus, in accordance with the present invention, is generally indicated at 10 in FIG. 1. In the preferred form, the apparatus 10 has an inlet hopper or chute 14 which receives and guides a mixture of turnings, chips and tramp material (such as heavy metal scrap) into the apparatus in the direction of the material flow arrow 16. The material may be fed into the chute by any suitable means including automated or non-automated mechanical apparatus, or by hand.

The material falls from the inlet chute 14 onto a feeder tray 18 which defines a conveying path and functions as a conveyor means to move the mixture of material from the right to the left as viewed in FIG. 1, in a mannner to be described in detail hereinafter. The feeder tray 18 is preferably enclosed in an enclosure comprising generally vertical side wall means 20 and generally horizontal top wall means 22.

The feeder tray 18 is mounted on a platform or base 24 comprising a suitable structural framework, including various vertical support members 26 and various horizontal support member 28. The feeder tray is preferably mounted on the base 24 with means for allowing movement, especially oscillatory movement, relative to the base 24. Preferably such means include spring plates 30 which may be bolted between suitable angle members 32 welded to the underside of the feeder tray 18 and to angle members 34 welded to the horizontal support members 28. The spring plates 30 permit movement of the feeder tray 18 vertically, as well as horizontally to the left or right relative to the base 24 as viewed in FIG. 1.

To provide a conveying action of the mixture of material on the feeder tray 18, the feeder tray 18 is preferably oscillated relative to the fixed base 24 by means of an oscillator motor means 36 which, through a suitable eccentric drive mechanism, causes an arm 38 to undergo cyclical movement in a predetermined locus. Arm 38 is pivotally connected about pivot pin 40 to a bracket 42 on the feeder tray 18. The cyclical movement of arm 38 thus causes the feeder tray 18 to undergo an oscillatory movement. The spring plates 30 cooperate to properly support the feeder tray 18 and to, at the same time, allow the feeder tray 18 to be oscillated by the arm 38 with a minimum transfer of impact loading to the base 24. In some instances, it may be desirable to slope or slant the feeder tray 18 so that the end under the inlet chute 14 is higher than the rest of the feeder tray 18.

Figure 2:
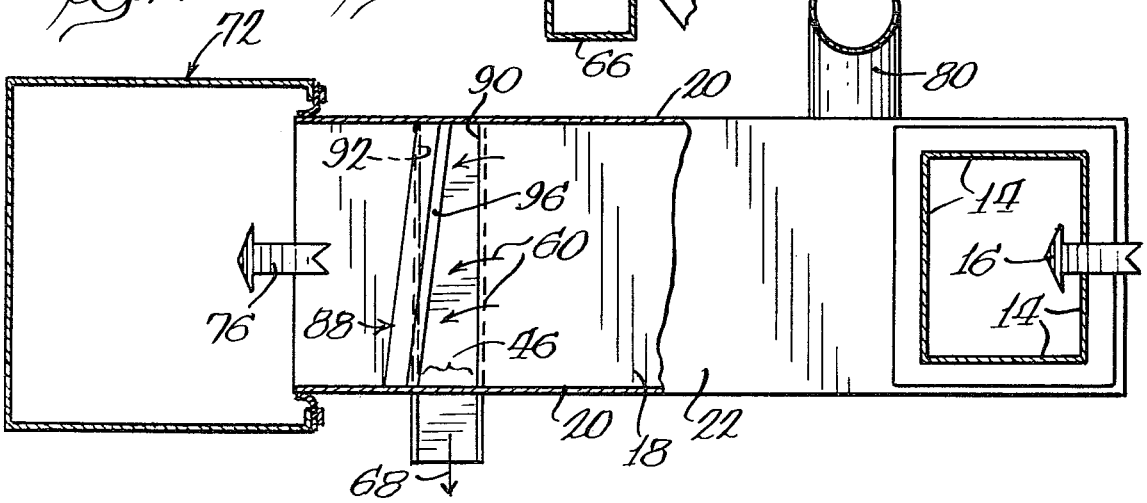
FIG. 2 is a cross-sectional view taken generally along the plane 2—2 in FIG. 1.

With reference to FIG. 2, it can be seen that the feeder tray 18, at the down stream section, away from the inlet chute 14, defines an elongate aperture 46 transverse to the conveying path of the feeder tray 18. A blower means or centrifugal fan 50, having an extension discharge nozzle 52, is mounted on base 24 below the feeder tray 18 so that the fan may discharge a fluid stream, such as a gas stream designated by arrow 54 in FIG. 1, through the elongate aperture 46. The centrifugal fan 50 is preferably driven by a suitable motor 56 through a drive belt 58.

As the mixture of material is oscillated and conveyed along the feeder tray 18, it is dumped off of the feeder tray 18 into a free-fail area or region defined by the aperture 46 and into the path of the gas stream 54 passing through the aperture. The lightweight chips and turnings are carried by the gas stream 54 away from the free-fall area and out of the aperture 46. The arrows 60 indicate the dumping path of the mixture of material as illustrated in FIG. 2. The heavier objects, such as the large scrap and tramp pieces, are too heavy to be blown out of the aperture 46 by the stream of gas 54 and thus fall downwardly, under the influence of gravity, below the feeder tray 18.

A collecting trough 66 may be provided below the aperture 46 to collect the scrap and tramp material. The collecting trough 66 may be slanted downwardly to one side below the feeder tray 18 for discharging the tramp material, along the path illustrated by arrow 68 to some suitable collecting means (not illustrated).

The lightweight turnings and chips are carried by the fluid stream 54 into a suitable collecting enclosure 72 where the turnings and chips can fall under the influence of gravity out of the dissipating fluid stream 54 in a generally downwardly direction, indicated by the flow arrow 76, to some suitable collection reservoir or further processing conveyor means (not illustrated).

Preferably, the separating fluid, indicated by the discharge stream 54, is re-used. To this end, as the fluid dissipates in the collecting enclosure 72, it is directed, as indicated by arrow 78, to a return duct 80 which communicates between the collecting enclosure 72 at connection aperture 84 and the suction of the blower 50. In this manner, the fluid is continuously cycled from the blower discharge through the feeder tray 18 collecting enclosure 72 and return duct 80.

To prevent the very lightweight chips and turnings and other particles from being carried by the gas stream through the return duct 80 to the suction of the blower, where they could damage the blower, the return duct 80 inlet aperture 84 preferably is located on the collecting enclosure 72 and away from the effects of the discharging gas stream 54. Further, a baffle plate 86 is disposed in the trajectory of the blown chips and particles adjacent the connection aperture 84 of the return gas duct 80. Thus, the very lightweight chips that do not fall downwardly under the influence of gravity and which are instead carried towards the connection aperture 84 will impinge upon the baffle plate 86 and then fall downwardly under the influence of gravity into the separate chip processing path or collecting reservoir. In this manner, it is seen that the amount of lightweight chips and turnings that may be blown into the return duct 80 is substantially reduced and that the need for a separate screen at the return duct aperture 84 may be eliminated. On the other hand, if a screen is used at the return duct aperture 84 or elsewhere in the duct system to provide additional protection for the blower 50, such a screen will not plug up as rapidly with very lightweight material as would occur in the absence of the novel baffle plate 86.

From time to time, scrap or tramp material having an elongate shape may be carried along the conveying path on the feeder tray 18 towards the elongate aperture 46 where, if the elongate scrap material is long enough, it may extend across the aperture 46 and bridge the aperture gap without falling through the gap. In fact, the scrap material may then be conveyed right over the gap and into the chip collecting reservoir. To prevent this from occurring, an abutment member 88 is provided on the feeder tray 18.

In order to accurately describe the structure of the abutment member 88, its relationship with the aperture 46, and its effect on preventing elongate scrap material from passing over the aperture 46, it is beneficial to note that the feeder tray 18 has an upstream region which defines an upstream side 90 of the aperture 46 and a downstream region which defines downstream side 92 of the aperture 46 opposite the upstream side (FIG. 2). The aperture sides 90 and 92 are generally transverse to the conveying path of the conveying means or feeder tray 18 and the perpendicular distance between the upstream and downstream sides 90 and 92, respectively, is less than the length of both of the aperture sides 90 and 92.

The abutment member 88 is preferably located at the downstream side 92 of the aperture 46 and is preferably angled with respect to the conveying direction of the material. Specifically, the abutment member 88 is displaced outwardly from, and downstream of, the upstream side 90 of the aperture 46 and, at one end, extends over a portion of the aperture 46. At the other end, the abutment member 88 is even with the downstream side 92 of the aperture 46.

Preferably, the abutment member has a beveled contact surface 96 which slants upwardly from the surface of the feeder tray 18 and which increases in height above the feeder tray 18 with increasing downstream distance along the conveying path of the feeder tray 18. In operation, when the leading portion of an elongate piece of tramp or scrap material begins to extend over the aperture 46, the leading portion comes into contact with the abutment member 88 and is, owing to the angled orientation of the abutment member 88, deflected or turned at an angle with respect to the conveying path whereby it is eventually oriented so that if fits lengthwise within the elongate aperture 46 and drops therethrough. The upwardly slanting surface 95 of the abutment member 88 further serves to enhance this effect. The leading portion of an elongate piece of scrap material may be driven upwardly along the surface 96. As the leading portion of the elongate piece of scrap is forced further upwardly above the surface of the feeder tray 18, less and less of the piece of scrap material remains on the feeder tray 18, and eventually, the scrap material will be completely free of the feeder tray 18 and drop through the aperture 46. In this respect, the slanting surface 96 aids in effecting a downwardly dropping motion of the piece of scrap material through the aperture 46.

Figure 3:
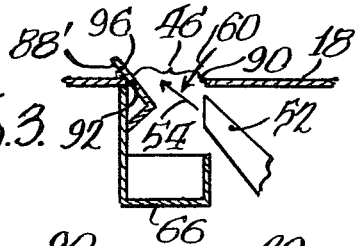
FIG. 3 is a cross-sectional view similar to FIG. 2 but showing another embodiment of the present invention.

Another form of an abutment member that prevents scrap material from bridging the aperture in the feeder tray is illustrated in FIG. 3 and is designated 88' therein. In this embodiment the abutment member 88' is located along the downstream side 92 of the aperture 46 and may be fabricated from a steel angle.

The abutment member 88' need not be angled with respect to the conveying direction of the material as is the first embodiment of the abutment member 88 discussed above. Instead, the abutment member 88' may be aligned substantially parallel with the downstream side 92 of the aperture 46 and hence, generally perpendicular to the direction of the flow of material as illustrated in FIG. 3 as long as abutment member 88' orients an approaching tramp object for passage through aperture 46.

Regardless of whether or not the abutment member 88' is oriented at an angle with respect to the conveyor flow path, it is preferable that the abutment member 88' present a generally upwardly slanting surface 96. The upwardly slanting surface 96 preferably extends from about one half inch above the feeder tray 18 to a few inches below the feeder tray 18. Although the upwardly slanting surface 96 is shown as being provided by a generally right-angled member 88', a flat member or plate can also be suitably mounted within the aperture 46 to provide the upwardly slanting surface.

In operation, when the leading portion of an elongate piece of tramp or scrap material begins to extend over the aperture 46, the leading portion of the material comes into contact with the abutment member 88' and, owing to the upwardly angled orientation of the surface 96, is deflected upwardly with respect to the conveying path. As the scrap material is moved further along the path against the abutment member 88', the leading portion of the scrap material is forced higher until the trailing end of the scrap material clears the upstream side 90 of the aperture 46, at which time the entire piece of scrap material then falls downwardly, trailing portion first, through the aperture 46 and into the collecting trough 66.

In most cases when an elongate piece of tramp or scrap material is being urged upwardly on the abutment member 88', the leading portion will tend to slide sideways, transverse to the conveying path. Thus, in most cases, the elongate tramp material will fall through the aperture 46 in a somewhat lengthwise orientation as well as in an orientation with the trailing portion lower than the leading portion.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. The method of separating chips from a mixture of such chips and tramp objects heavier than said chips, said method comprising:

moving said mixture of chips and tramp objects along a generally horizontally disposed oscillating mixture feeder tray defining a conveying path and defining an aperture disposed (1) between substantially coplanar upstream and downstream regions of said path and (2) transverse to said conveying path;

conveying said mixture off of said conveying path and into a free-fall region in said aperture;

providing an abutment means at the downstream side of said aperture and along said aperture, said abutment means including a member having a contact surface for deflecting a leading portion of a tramp object to one side of said conveying path, at least a portion of said contact surface located within said aperture, one end of said contact surface being closer to said path upstream region than the other end;

deflecting a leading portion of a tramp object present in said mixture away from said downstream region of said path with said abutment member contact surface while continuing to convey the trailing portion of said object over said aperture into said free-fall region whereby the tramp object is turned at an angle with respect to said conveying path and is oriented for passage through said aperture; and providing a blower means for producing a gas stream and directing a stream of gas from said blower means through said aperture to blow said chips away from said aperture free-fall region and into a separate chip processing path while said tramp object falls through said aperture free-fall region under the influence of gravity.

2. The method in accordance with claim 1 in which said step of deflecting a leading portion of a tramp object includes moving said tramp object along said conveying path into said free-fall region so that said tramp object projects over said free-fall region and said leading portion is deflected upwardly away from said downstream region of said path.

3. The method in accordance with claim 2 in which said step of upwardly deflecting said leading portion of a tramp object includes contacting said leading portion with said contact surface disposed at the downstream region of said path and increasing in height above said path with increasing downstream distance from said free-fall region.

4. The method in accordance with claim 1 in which said step of conveying said mixture includes conveying said mixture off of said conveying path into said free-fall region defined by said aperture having a dimension transverse to said conveying path greater than the dimension parallel to said conveying path.

5. The method of separating chips from a mixture of such chips and tramp objects heavier than said chips, said method comprising:

moving said mixture of chips and tramp objects along a generally horizontally disposed oscillating mixture feeder tray defining a conveying path and defining an aperture disposed (1) between substantially coplanar upstream and downstream regions of said path and (2) transverse to said conveying path;

providing an abutment means at the downstream side of said aperture and along said aperture, said abutment means including a member having a contact surface for deflecting a leading portion of a tramp object to one side of said conveying path, at least a portion of said contact surface located within said aperture, one end of said contact surface being closer to said path upstream region than the other end;

conveying said mixture off of said conveying path and into a free-fall region in said aperture;

providing a blower means for producing a gas stream and directing a stream of gas from said blower means through said aperture to blow said chips away from said aperture free-fall region and into a separate chip processing path while said tramp objects fall through said aperture free-fall region under the influence of gravity;

receiving said gas stream in a return duct inlet;

returning said gas stream through a return duct to said blower; and impinging said blown chips upon a baffle plate adjacent said gas stream return duct inlet whereby said blown chips are caused to fall downwardly under the influence of gravity into said separate chip processing path.

6. The method in accordance with claim 5 in which said step of moving said mixture includes moving said mixture below said return duct inlet and said step of directing a stream of gas includes directing the gas stream upwardly through said free-fall area towards said return duct inlet.

7. The method of separating chips from a mixture of such chips and tramp objects heavier than said chips, said method comprising:

feeding said mixture of chips and tramp objects onto a generally horizontally disposed oscillating mixture feeder tray defining a conveying path and defining an aperture disposed (1) between substantially coplanar upstream and downstream regions of said path and (2) transverse to said conveying path;

oscillating said conveyor to convey said mixture off of said upstream region of said conveying path and into a free-fall region in said aperture;

providing an abutment means at the downstream side of said aperture and along said aperture, said abutment means including a member having a contact surface for deflecting a leading portion of a tramp object to one side of said conveying path, at least a portion of said contact surface located within said aperture, one end of said contact surface being closer to said path upstream region than the other end;

deflecting a leading portion of a tramp object present in said mixture at least in a direction away from said downstream region of said path with said abutment member contact surface while continuing to convey the trailing portion of said object over said aperture into said free-fall region whereby the tramp object is turned at an angle with respect to said conveying path and is oriented for passage through said aperture; and providing a blower means for producing a gas stream and directing a stream of gas from said blower means through said aperture to blow said chips away from said aperture free-fall region and into a separate chip processing path while said tramp object falls through said free-fall region under the influence of gravity.

8. The method in accordance with claim 7 in which said mixture is fed on the conveyor generally horizontally along the conveying path substantially normal to the direction of the force of gravity.

* * * * *